US005265304A

United States Patent [19]

Hughes

[11] Patent Number: 5,265,304

[45] Date of Patent: Nov. 30, 1993

[54] PORTABLE CLEANING APPARATUS

[75] Inventor: Joel Hughes, Wilmington, N.C.

[73] Assignee: Container Products Corp., Wilmington, N.C.

[21] Appl. No.: 986,344

[22] Filed: Dec. 7, 1992

Related U.S. Application Data

[63] Continuation-in-part of Ser. No. 937,147, Aug. 31, 1992.

[51] Int. Cl.[5] ..... B08B 7/04

[52] U.S. Cl. ..... 15/302; 15/305; 15/321

[58] Field of Search ..... 15/302, 305, 310, 311, 15/321

[56] References Cited

U.S. PATENT DOCUMENTS 3,811,148 5/1974 Martin ..... 15/305 X 3,956,791 5/1976 Rütten ..... 15/305 X 4,058,868 11/1977 Champion ..... 15/305 X

FOREIGN PATENT DOCUMENTS 439472 1/1975 U.S.S.R. ..... 15/305

*Primary Examiner*—Chris K. Moore

[57] ABSTRACT

A portable cleaning apparatus including means for suctioning spent cleaning fluid and recoverable debris, dirt and contaminates from the surface being cleaned, including a portable cart housing a auger type tumbler adapted to received vacuumed debris and wherein the tumbling debris is subject to blast spray cleaning liquids. A recovery chamber at one end of the tumbler provides a closed trap door that retains cleaned debris within the cart until the vacuum suction is disrupted at which time, the trap door is opened, the debris is then deposited, thoroughly cleaned onto the supporting surface.

17 Claims, 3 Drawing Sheets

FIG. 1
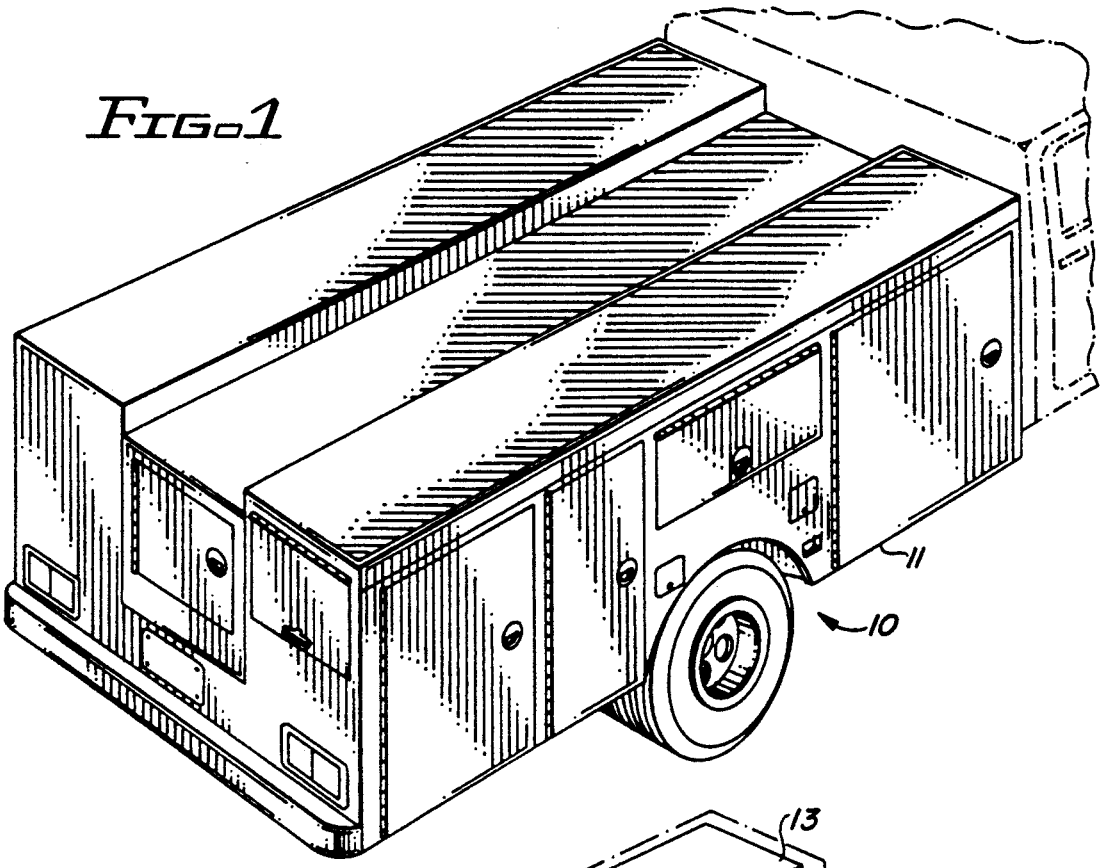
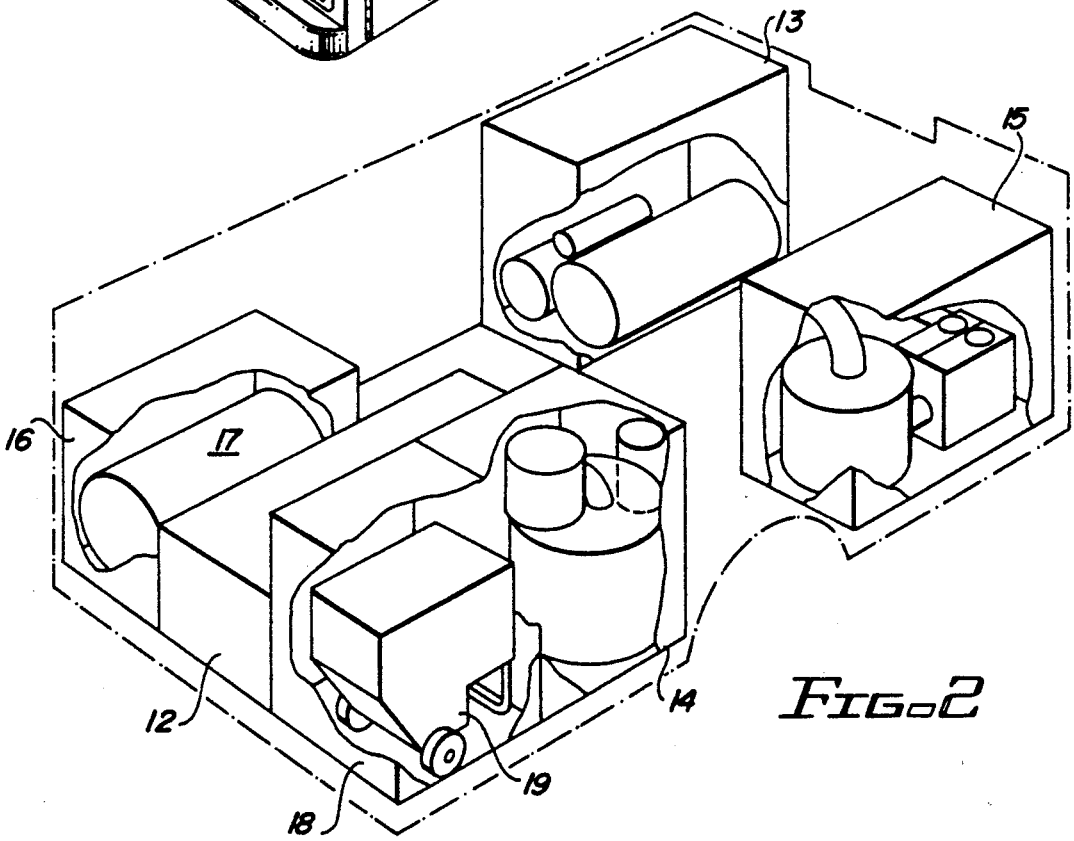
FIG. 2

FIG. 3
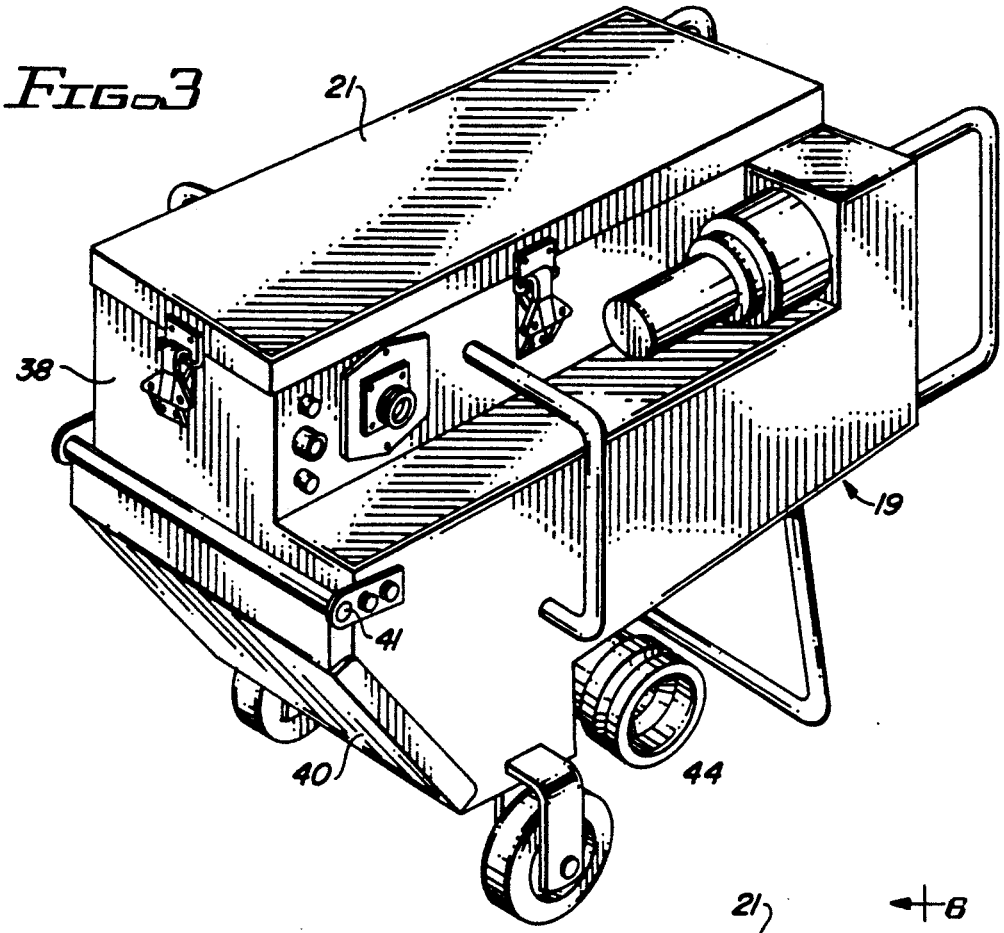
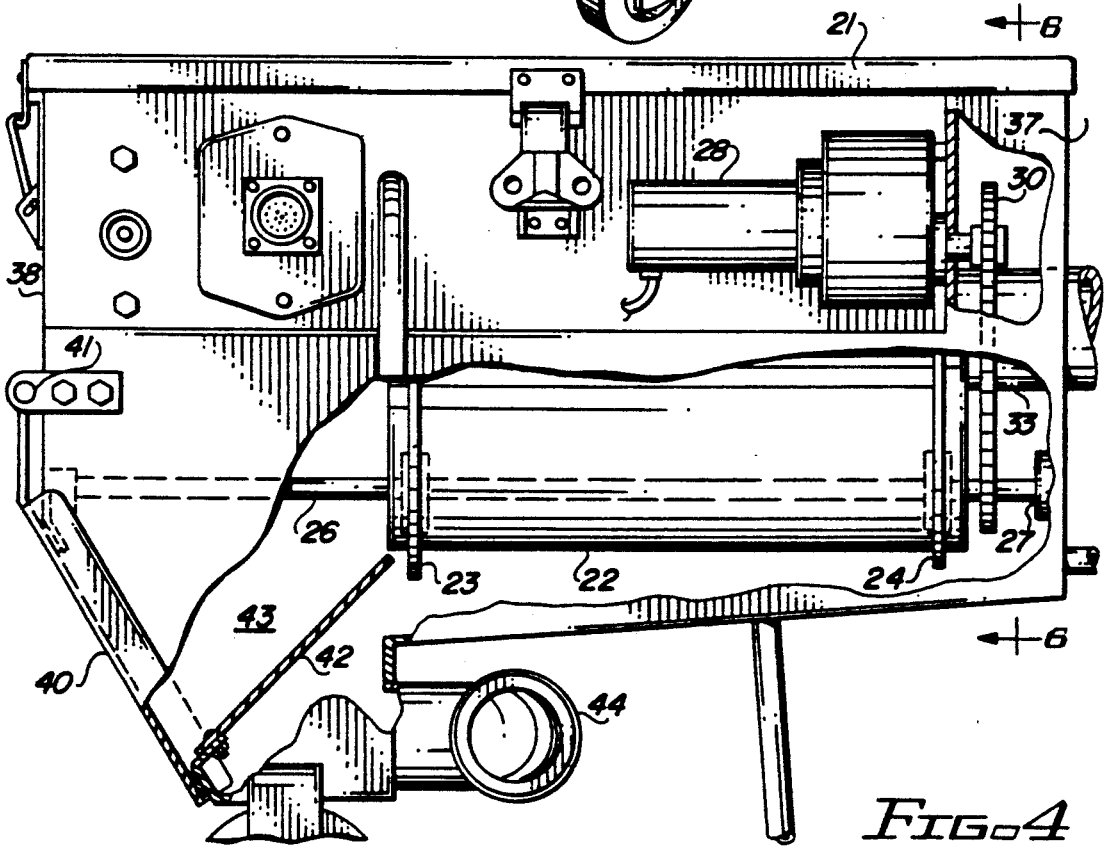
FIG. 4

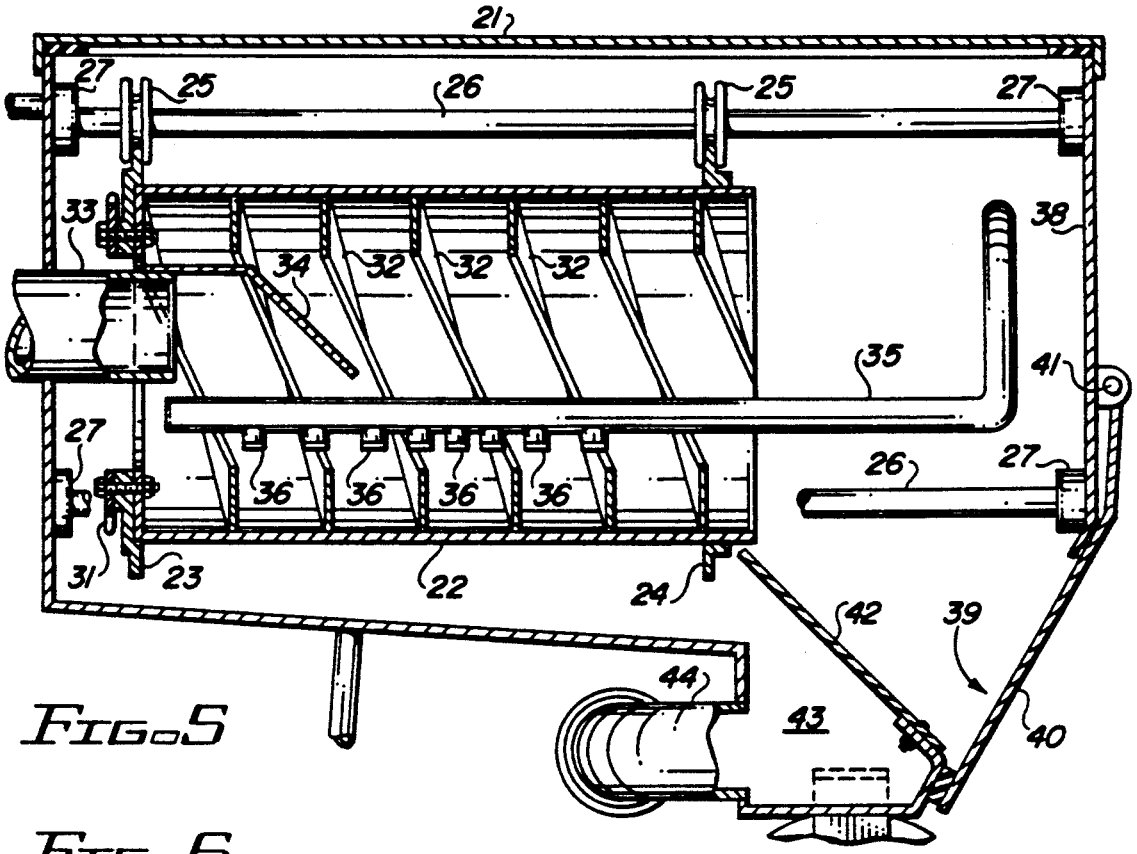
FIG. 5
FIG. 6
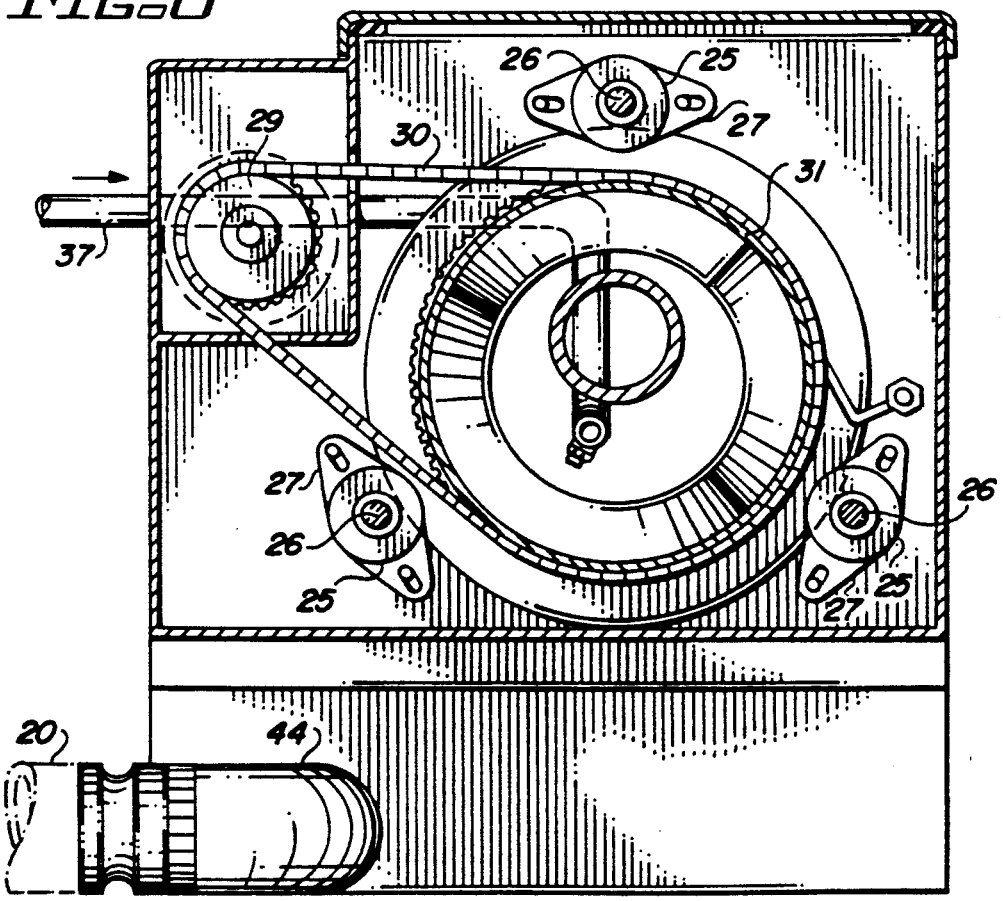

PORTABLE CLEANING APPARATUS

This is a continuation-in-part application of a U.S. Pat. application Ser. No. 07/937,147 filed Aug. 31, 1992.

BACKGROUND OF THE INVENTION

Machines have been design to clean fixed surfaces such as floors, walls and structures, with a forced liquid spray or sand blasting, together with the vacuum recovery of the spent cleaning medium, and the unwanted dirt and debris. See for example U.S. Pat. No. 4,149,345, dated Apr. 17, 1979, and its cited references; U.S. Pat. No. 2,628,456, dated Jan. 15, 1952, and its cited references.

Suction recovery of unwanted dirt and debris through remote tool heads or enclosures have normally been limited to air or liquid borne particulates such as is shown and described in U.S. Pat. No. 4,444,146, dated Apr. 24, 1984 and its cited references.

However few attempts have been made at cleaning weighted objects such as gravel and rocks which are vacuumed ingested into a cleaning tumbler wherein the articles are subject to pressurized heated liquid spray cleaning. The same vacuum that ingested the articles into the tumbler recovers the removed dirt, debris and contaminates as well as the cleaning fluid from the tumbler for safe environmentally controlled disposal.

SUMMARY OF THE INVENTION

This invention relates to a cleaning apparatus and more particularly to a device that will clean gravel and rocks at their situs by providing a vacuum ingesting system whereby the gravel and or rocks are deposited into a auger type tumbler. As the vacuumed debris is caused to travel through the tumbler it is subject to super heated pressurized liquid blast spraying. The vacuum which initially suctioned the gravel or rock into the tumbler will also function to vacuum-recover the spent cleaning liquid and removed waste and contaminate and subject the same to a liquid/particle separator and filter for containment and environmental safe disposal. The apparatus permits readily redepositing of the cleaned material onto its original situs.

Another object of the invention is to provide a highly portable cleaning apparatus that may be transported for use at remote sites such as beaches, utility sub-stations and unpaved roads, with the cleaning operation being completely contained within the apparatus thus totally environmentally safe.

Various advantages and features of novelty which characterize the invention are set out with particularity in the description and claims annexed hereto and forming a part hereof.

BRIEF DESCRIPTION OF THE DRAWINGS

The invention will best understood by reference to the accompanying drawings which illustrate the preferred form of construction and arrangement of parts by which the objects of the invention are achieved and in which;

FIG. 1 is a fragmentary perspective view of the self-contained mobile vehicle containing the invention;

FIG. 2 is a schematic view of the compartmentized arrangement of the cooperative elements of the invention;

FIG. 3 is a perspective view of the remote rock cleaner of this invention;

FIG. 4 is a fragmentary side elevational view of the rock cleaner;

FIG. 5 is a detailed side sectional view of the rock cleaner, and

FIG. 6 is a detailed section end view of the rock cleaner of this invention.

DETAILED DESCRIPTION OF THE INVENTION

This invention is adapted to be associated with a totally self-contained and self-supporting truck mounted cleaning and retrieval system and thus maybe an integral part of a mobile vehicle 10 that supports the compartmentized body 11, all of which is perspectively shown in FIG. 1.

Referring to FIG. 2 there is schematicaly illustrated the relationship of the interconnected compartments wherein compartment 12 is identified with a fluid supply tank; compartment 13 houses the main liquid circulating pump and the fluid super heater and initial filter; compartment 14 encloses the liquid/particle filtering system while compartment 15 holds the liquid ring vacuum pump.

When the power driven elements of the cleaning and retrieving system requires an electrical power source compartment 16 will contain a generator 17.

The vehicle body 11 will also provide a compartment 18 for the housing of auxiliary remote cleaning tools such as a rock cleaner as indicated.

The self-contained cleaning and retrieval system of FIGS. 1 and 2, includes the present invention. As shown in FIGS. 3 through 6 there is illustrated a portable cleaning tool 19 designed for remote use with the system. This cleaning tool 19 is housed in compartment 18 of the vehicle 10, and is adapted to be connected to the cleaning fluid dispensing and retrieval system of the apparatus through a umbilical-like hose 20, (see FIG. 6).

The cleaning tool 19 is primarily a gravel and rock cleaner consisting of a wheeled cart 21 in which is rotatably mounted an auger type tumbler 22. The tumbler 22 is tubular in construction, and open at both ends and includes circumferentially extending support rings 23 and 24. These support rings 23 and 24 will in turn ride on a series of rollers 25. These rollers 25 as shown in FIGS. 5 and 6 are diametrically arranged on support rods 26 which have their ends journaled in bearings 27 fixedly mounted on the interior walls of the cart 21.

A power source 28, such as an electric motor, includes a driven gear 29 that through a chain 30 drives a tooth gear 31 fixedly mounted on one end of the tumbler 22. When energized the power source 28 through the chain 30 rotates the tumbler 22 within the cart 21.

The tumbler 22 is equipped internally with a series of fins 32 arranged in auger-like fashion. Communicating with the interior of the tumbler 22 is a vacuum intake hose 33. The external end of the hose 33 supports a suitable pick up nozzle type tool not shown. A deflector flange 34 (FIG. 5) is mounted on the inner end of the intake hose 33 and is adapted to deflect the suctioned gravel or rocks into the tumbler 22. As an alternate construction, the flange 34 may be omitted and the inner end of the intake hose 33 may be designed so as to angularly direct the ingested material into the front end of the tumbler 22.

A cleaning fluid manifold 35 extends inwardly of the tumbler 22 through its opposite open end, and provides a series of dispensing nozzles 36 through which the heated pressurized cleaning fluid from the vehicle is introduced with a blast type impact upon the rocks ingested into the tumbler 22. The manifold 35 through a suitable conduit 37 is connected to the liquid heater and pump situated in compartment 13 of the vehicle 10.

The closed end wall 38 of the cart 19 is formed to provide an opening 39 (FIG. 5) that is normally closed by a door 40 that is hinged as at 41 to the end wall 38 of the cart 19. A suitable latch (not shown) for the door may be included and it together with the vacuum within the cart 19, will maintain the door 40 in a closed condition during operation. Adjacent to the opening 39 and extending at an angle so as to terminate at the exit end of the tumbler 22 is a fine screen flange 42. To one side of the screen flange 42 is an exhaust chamber 43 having open communication with an exhaust port 44 which in turn is adapted to receive one end of the umbilical-like hose 20. A material receiving basket (not shown) may be included within the chamber 43 for the collection of cleaned debris.

The operation of the rock cleaning tool 19 commences with a negative vacuum being created within the cart 21 by the actuation of the liquid ring vacuum pump housed in compartment 16 of the vehicle 10. This vacuum through a suitable pick up tool will vacuum contaminated rocks and gravel through hose 33 and into the tumbler 22.

Simultaneously with the deposit of the recovered rocks and gravel, pressurized superheated cleaning fluid from the circulating pump and super heater located in compartment 13, is introduced through nozzles 36 thus cleaning the rocks and gravel within the tumbler 22. The auger-like fins 32 will move the rock and gravel through the tumbler 22 and deposit them onto the screen flange 42 and against the door 40. The contaminates removed from the rocks as well as the spent cleaning fluid will pass through chamber 43, out the port 44 and through the umbilical-like hose 20 back to the liquid particle filtering system housed in compartment 15 of the vehicle 10.

During the cleaning operation the recovery vacuum may be periodically interrupted, at which time the door 40 is opened permitting the cleaned rock, or gravel, or other ingested material, to be removed from the cart 21.

From the foregoing it is readily apparent that the apparatus of this invention through the mobile vehicle 10 may be employed in remote areas away from power and water sources such as electrical sub-stations, power installations, as well as remote beach areas wherein the rock cleaner 19 may be utilized with the vehicle that retrieves and captures the waste contaminates for proper disposal.

In summary the apparatus of this invention provides a superheated liquid spray cleaning action that is hotter than steam cleaners and which produces blast impact of a pressure washer. The spray vacuum cleaning apparatus recovers solid waste and the superheated cleaning liquid, leaving no residue contamination. Through its powerful wet/dry vacuum system all recovery of the spent cleaning fluid and contaminations are directly contained in disposable containers. The system recovers, filters and recirculates the cleaning fluid used thus minimizing waste volume.

While I have illustrated and described the preferred form of construction for carrying my invention into effect, this is capable of variation and modification without departing from the spirit of the invention. I therefore do not wish to be limited to the precise details of construction as set forth, but desire to avail myself of such variations and modifications as come within the scope of the appended claims.

Having thus described my invention what I claim as new and novel and desire to protect by letters patent is:

1. A portable cleaning apparatus associated with a supply of pressurized heated cleaning fluids and a wet/dry vacuum recovery means by which a vacuum can be periodically induced in the apparatus comprising:

a) a portable cart-like body;
b) a rotatable tumbler within said body;
c) means for rotatably supporting said tumbler in said body;
d) means for rotating said tumbler about its longitudinal axis within said body;
e) a vacuum intake extending through one end of said body and into said tumbler, through which material to be cleaned is vacuum ingested;
f) means tumbling and progressively moving said ingested material through said tumbler and out the other end thereof;
g) means extending into said tumbler through which pressurized heated cleaning liquids are sprayed upon said ingested material as it is tumbled and progressively moved through said tumbler;
h) means within said body for collecting the tumbled and spray cleaned material as it is moved by said tumbling and moving means out of said other end of said tumbler, and
i) means through which said cleaned material is removed from said body.

2. A portable cleaning apparatus as defined by claim 1 wherein said means for rotating said tumbler about its longitudinal axis comprises an electric motor and chain drive.

3. A portable cleaning apparatus as defined by claim 1 wherein said means for tumbling and progressively moving said vacuum ingested material through said tumbler and out the other end thereof comprises auger-type fins mounted within said tumbler.

4. A portable cleaning apparatus as defined by claim 3 wherein said means for rotating said tumbler about its longitudinal axis comprises an electric motor and chain drive.

5. A portable cleaning apparatus as defined by claim 4 wherein said means extending into said tumbler through which pressurized heated cleaning liquids are sprayed upon said vacuum ingested material comprises a liquid intake and manifold including a series of spray nozzles extending within and parallel to the longitudinal axis of said tumbler.

6. A portable cleaning apparatus as defined by claim 1 wherein said means extending into said tumbler through which pressurized heated cleaning liquids are sprayed upon said vacuum ingested material comprises a liquid intake and manifold including a series of spray nozzles extending within an parallel to the longitudinal axis of said tumbler.

7. A portable cleaning apparatus as defined by claim 6 wherein said means for rotating said tumbler about its longitudinal axis comprises an electric motor and chain drive.

8. A portable cleaning apparatus as defined by claim 6 wherein said means for tumbling and progressively moving said vacuum ingested material through said tumbler and out the other end thereof comprises auger-type fins mounted within said tumbler.

9. A portable cleaning apparatus as defined by claim 1 wherein said means within said body for collecting the tumbled and spray cleaned material as it is moved out of said other end of said tumbler comprises a chamber defined by a screened panel and said means through which said tumbled and cleaned material is removed from said body.

10. A portable cleaning apparatus as defined by claim 9 wherein said means for rotating said tumbler about its longitudinal axis comprises an electric motor and chain drive.

11. A portable cleaning apparatus as defined by claim 9 wherein said means for tumbling and progressively moving said vacuum ingested material through said tumbler and out the other end thereof comprises auger-type fins mounted within said tumbler.

12. A portable cleaning apparatus as defined by claim 9 wherein said means extending into said tumbler through which pressurized heated cleaning liquids are sprayed upon said vacuum ingested material comprises a liquid intake and manifold including a series of spray nozzles extending within an parallel to the longitudinal axis of said tumbler.

13. A portable cleaning apparatus as defined by claim 1 wherein said means through which said tumbled and cleaned material is removed from said body comprises a hinged door normally held closed by the vacuum within said body.

14. A portable cleaning apparatus as defined by claim 13 wherein said means for rotating said tumbler about its longitudinal axis comprises an electric motor and chain drive.

15. A portable cleaning apparatus as defined by claim 13 wherein said means for tumbling and progressively moving said vacuum ingested material through said tumbler and out the other end thereof comprises auger-type fins mounted within said tumbler.

16. A portable cleaning apparatus as defined by claim 13 wherein said means extending into said tumbler through which pressurized heated cleaning liquids are sprayed upon said vacuum ingested material comprises a liquid intake and manifold including a series of spray nozzles extending within an parallel to the longitudinal axis of said tumbler.

17. A portable cleaning apparatus as defined by claim 13 wherein said means within said body for collecting the tumbled and spray cleaned material as it is moved out of said other end of said tumbler comprises a chamber defined by a screened panel and said door through which said tumbled and cleaned material is removed from said body.

* * * * *